US010184201B2

(12) United States Patent
Kim et al.

(10) Patent No.: US 10,184,201 B2
(45) Date of Patent: Jan. 22, 2019

(54) BALANCER AND WASHING MACHINE INCLUDING THE SAME

(71) Applicant: Samsung Electronics Co., Ltd., Suwon-si (KR)

(72) Inventors: Sung Jong Kim, Suwon-si (KR); Min Sung Kim, Yongin-si (KR); Jeong Hoon Kang, Seoul (KR); Seung Oh Kim, Suwon-si (KR); Yee Lee Wong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/901,530

(22) PCT Filed: Jun. 27, 2014

(86) PCT No.: PCT/KR2014/005730

§ 371 (c)(1),
(2) Date: Dec. 28, 2015

(87) PCT Pub. No.: WO2014/209052

PCT Pub. Date: Dec. 31, 2014

(65) Prior Publication Data

US 2016/0145789 A1 May 26, 2016

(30) Foreign Application Priority Data

Jun. 27, 2013 (KR) ..... 10-2013-0074822
Jun. 19, 2014 (KR) ..... 10-2014-0075182

(51) Int. Cl.
*D06F 37/24* (2006.01)

(52) U.S. Cl.
CPC ..... *D06F 37/245* (2013.01)

(58) Field of Classification Search
None
See application file for complete search history.

(56) References Cited

U.S. PATENT DOCUMENTS

2004/0172987 A1* 9/2004 Lim ..... D06F 37/245 68/23.1
2008/0034917 A1* 2/2008 Jones ..... D06F 37/225 74/572.4

(Continued)

FOREIGN PATENT DOCUMENTS

CN 1526871 9/2004
CN 2900587 5/2007

(Continued)

OTHER PUBLICATIONS

Chinese Office Action for Application No. 201480036587.X dated Dec. 15, 2016 (16 pages).

(Continued)

*Primary Examiner* — Alexander Markoff
*Assistant Examiner* — Cristi J Tate-Sims
(74) *Attorney, Agent, or Firm* — Staas & Halsey LLP

(57) ABSTRACT

The present invention relates to a washing machine which includes a cylindrical part having a cylindrical shape and at least one balancer installed in the cylindrical part. The balancer includes a first balancer housing provided with a race in an annular shape with an open top and a second balancer housing to be coupled with the first balancer housing to cover the open top of the race. The balancer is installed in the cylindrical part in such a way that a coupling portion of the first balancer housing and the second balancer housing corresponding to an inner circumferential surface of the cylindrical part is covered by the cylindrical part, thereby reinforcing a strength of the balancer by the cylindrical part.

16 Claims, 10 Drawing Sheets

(56) References Cited

U.S. PATENT DOCUMENTS

| | | | | |
|---|---|---|---|---|
| 2010/0326141 | A1* | 12/2010 | Chung | D06F 23/04 68/23.2 |
| 2011/0041565 | A1 | 2/2011 | Hiller et al. | |
| 2012/0144875 | A1 | 6/2012 | Kim et al. | |
| 2012/0151685 | A1* | 6/2012 | Jang | D06F 35/007 8/137 |
| 2013/0174690 | A1* | 7/2013 | Yoshinari | D06F 37/245 74/572.4 |
| 2015/0184326 | A1* | 7/2015 | Seo | D06F 37/24 68/132 |
| 2015/0211163 | A1* | 7/2015 | Kim | D06F 17/08 68/133 |

FOREIGN PATENT DOCUMENTS

| | | | | |
|---|---|---|---|---|
| CN | 101280500 | | 10/2008 | |
| CN | 101994230 | | 3/2011 | |
| CN | 101994230 | A | 3/2011 | |
| CN | 102362027 | | 2/2012 | |
| CN | 102362027 | A | 2/2012 | |
| CN | 102443999 | | 5/2012 | |
| CN | 102510914 | | 6/2012 | |
| CN | 202492706 | | 10/2012 | |
| CN | 103911811 | | 7/2014 | |
| KR | 10-2005-0110072 | A | 11/2005 | |
| KR | 10-2010-0105198 | A | 9/2010 | |
| KR | 10-2011-0020364 | A | 3/2011 | |
| KR | 20110020364 | A * | 3/2011 | D06F 31/00 |
| KR | 10-2011-0051017 | A | 5/2011 | |
| KR | 10-2011-0012362 | A | 9/2011 | |
| KR | 20-2012-0007521 | U | 10/2012 | |
| KR | 10-1203422 | B1 | 11/2012 | |
| KR | 20-0465465 | Y1 | 2/2013 | |
| WO | 2010-107277 | A1 | 9/2010 | |

OTHER PUBLICATIONS

Australian Patent Examination Report for Appln. 2014299475 dated Apr. 8, 2016.

International Search Report for PCT/KR2014/005730 dated Oct. 16, 2014.

Australian Patent Notice of Acceptance for Appln. 2014299475 dated Jul. 28, 2016, dated Aug. 11, 2016.

Chinese Office Action for Application No. 201480036587.X dated Sep. 13, 2017 (11 pages).

Chinese Notice of Allowance for Application No. 201480036587.X dated Dec. 26, 2017 (5 pages).

* cited by examiner

[Fig. 1]
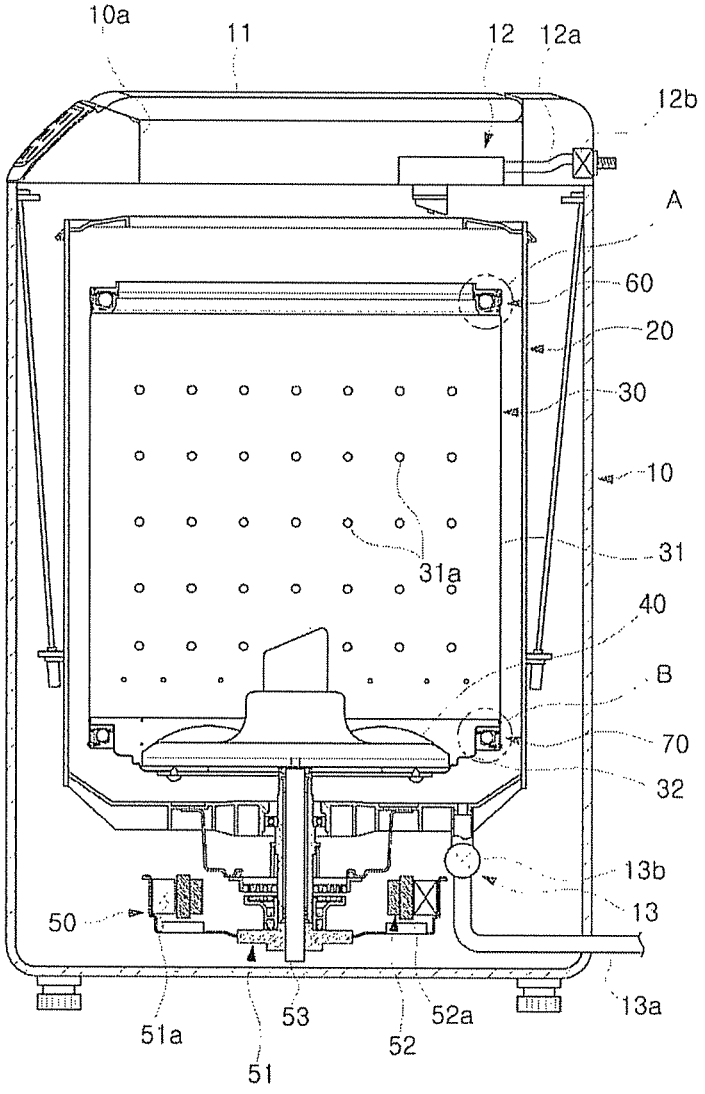

[Fig. 2]
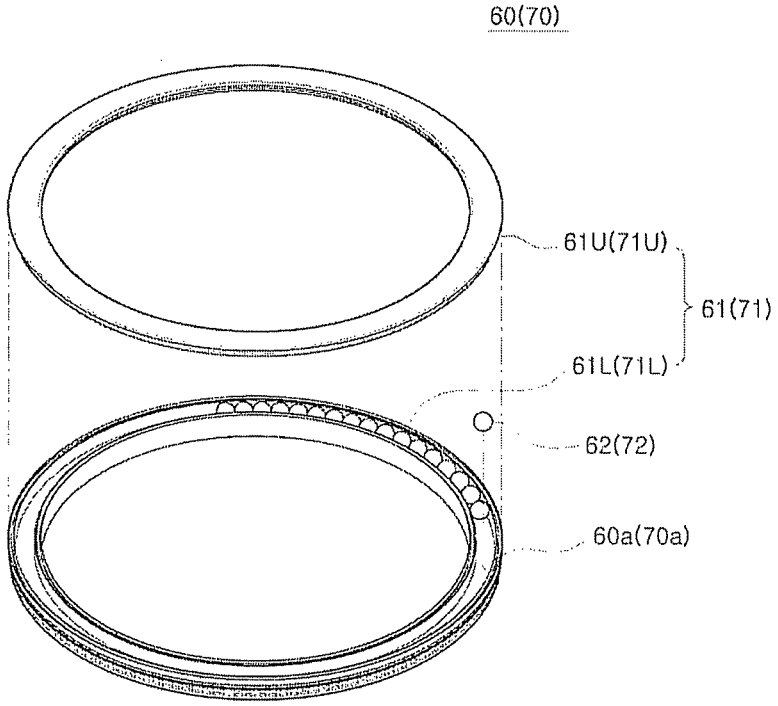
[Fig. 3]
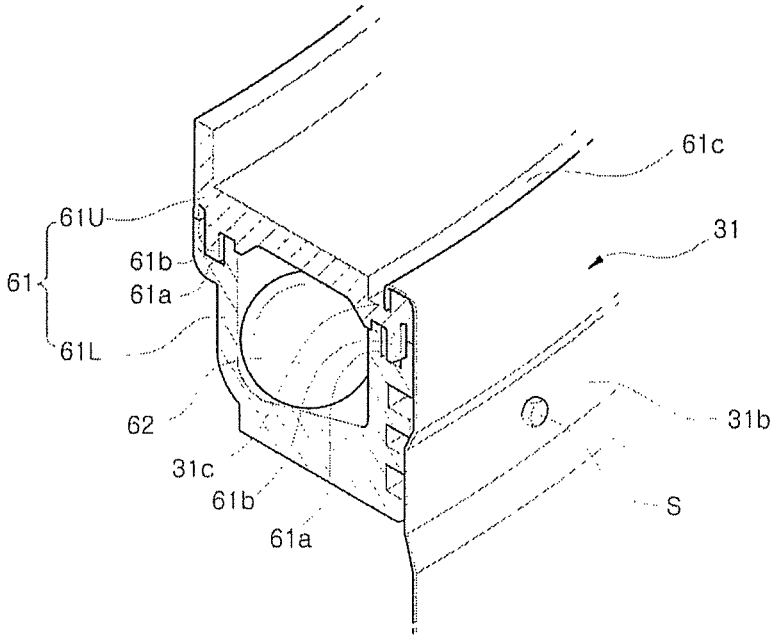

[Fig. 4]
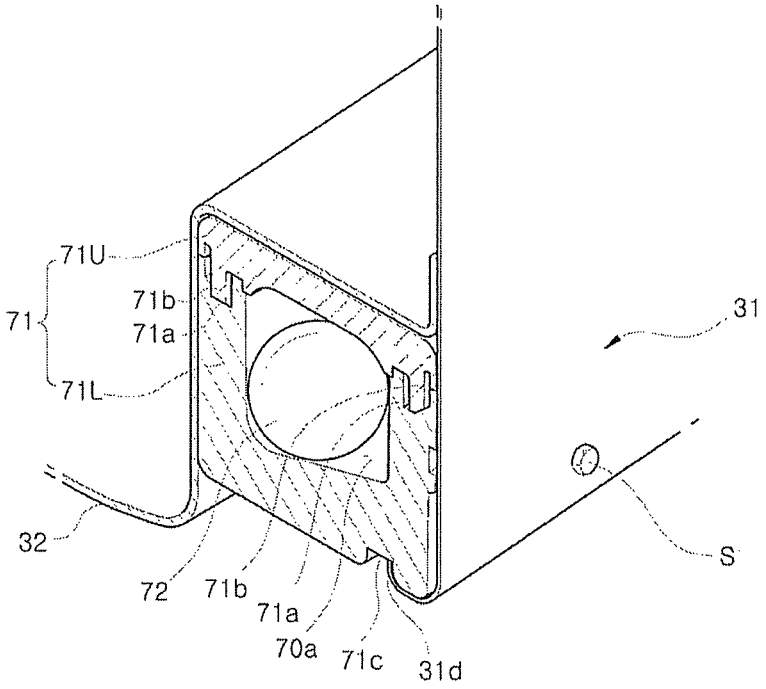

[Fig. 5]
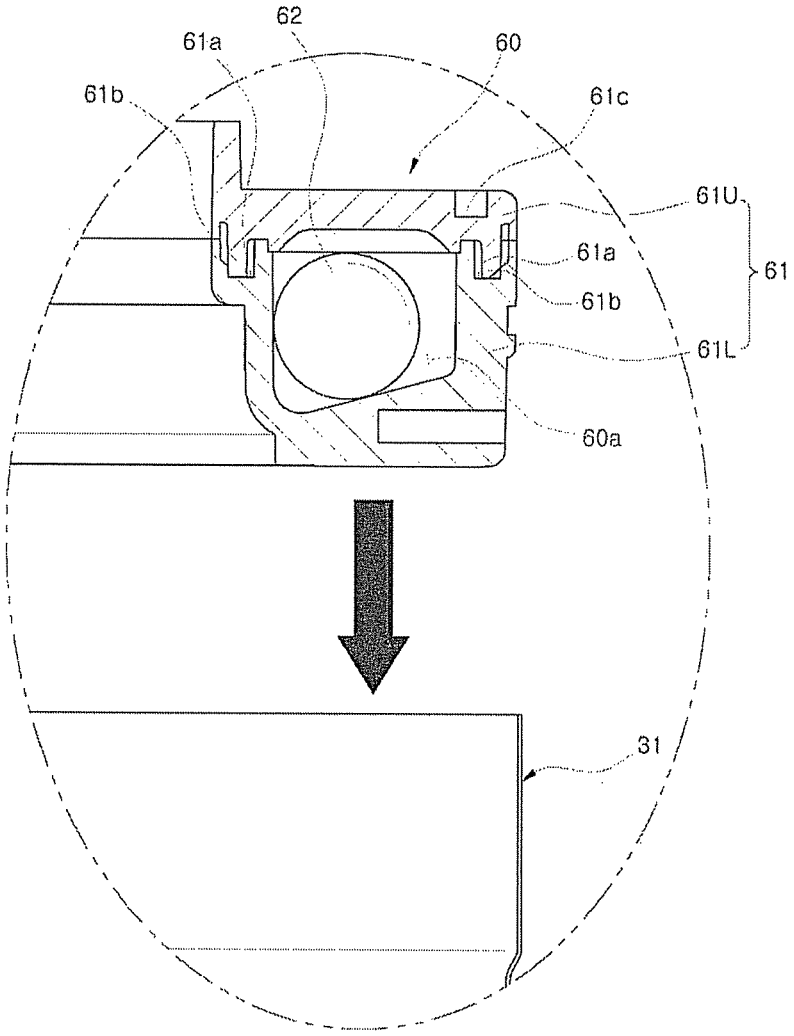

[Fig. 6]
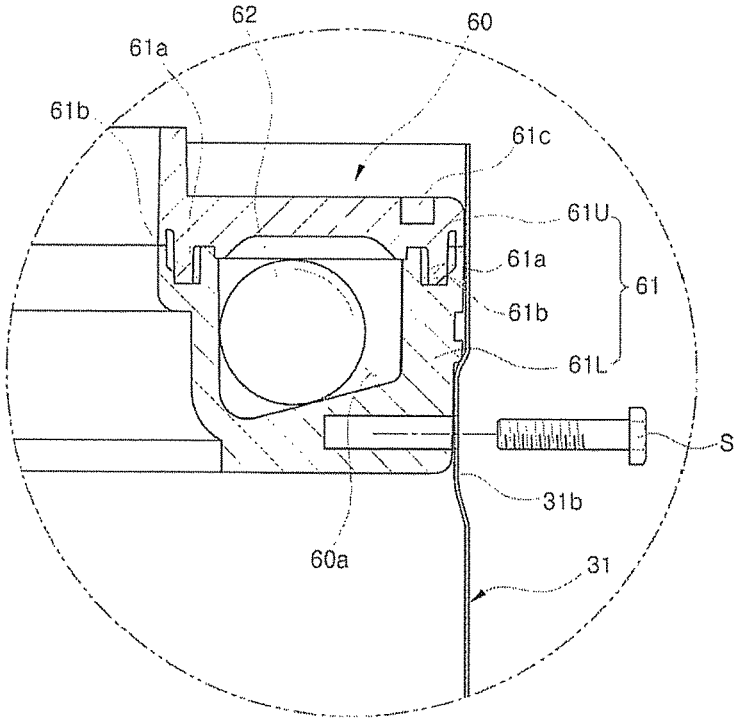
[Fig. 7]
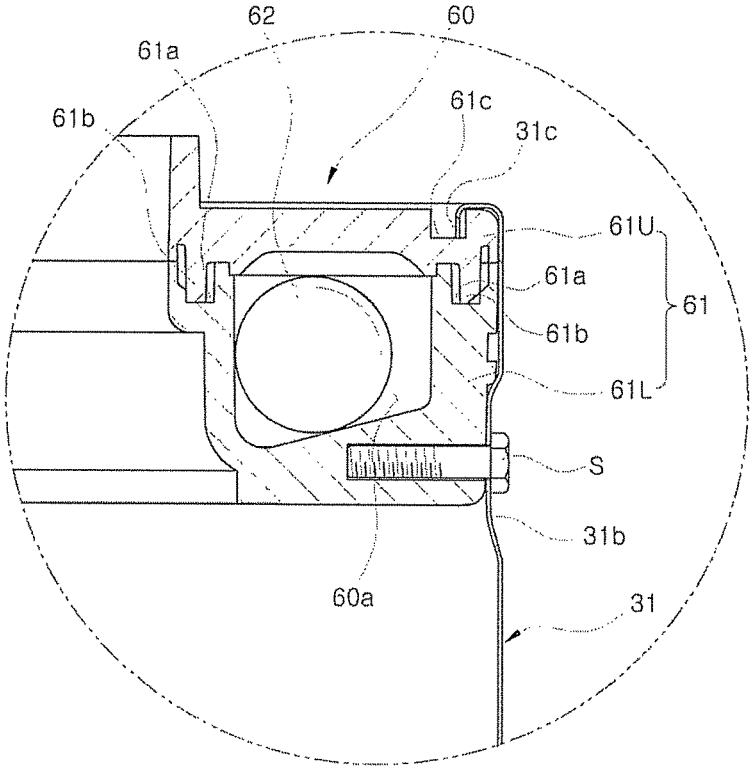

[Fig. 8]
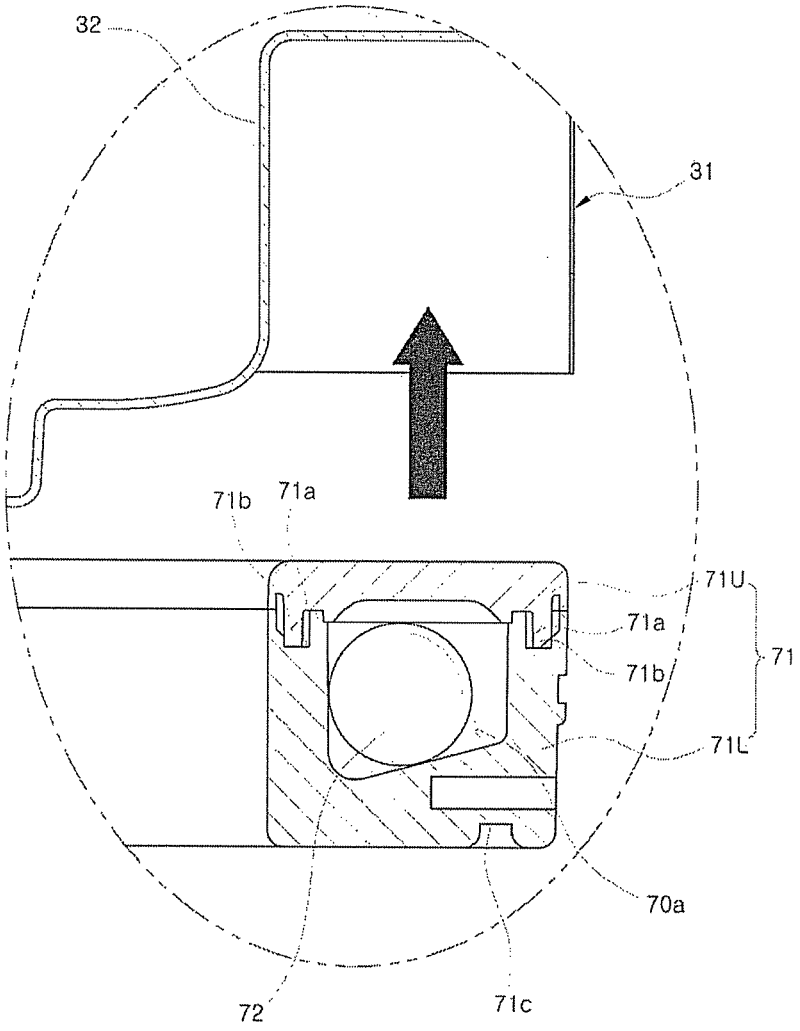

[Fig. 9]
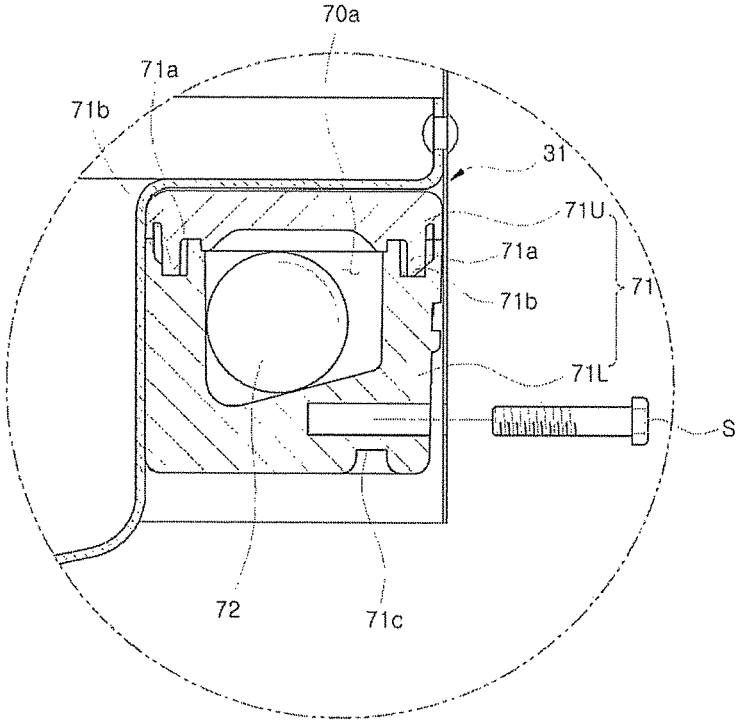
[Fig. 10]
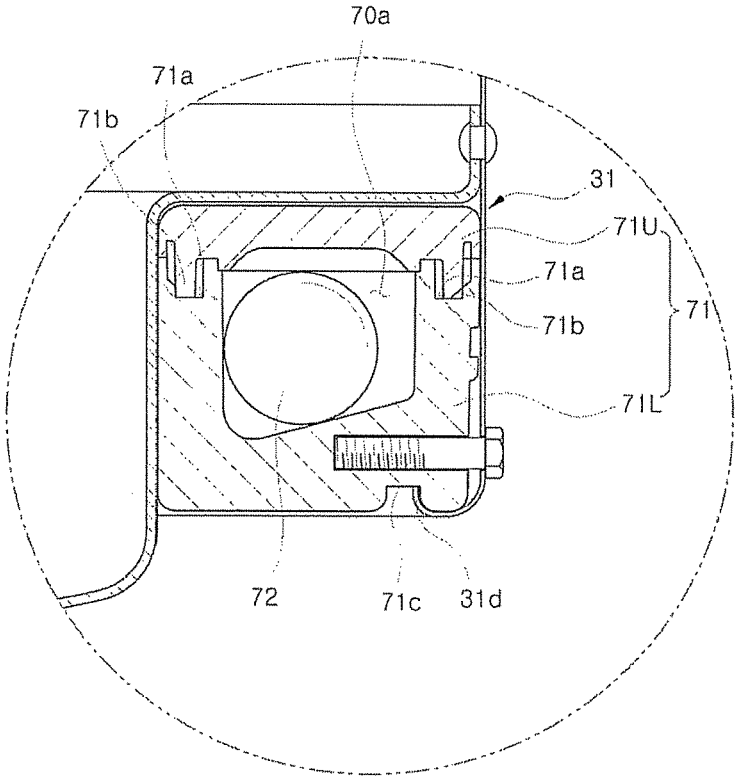

[Fig. 11]
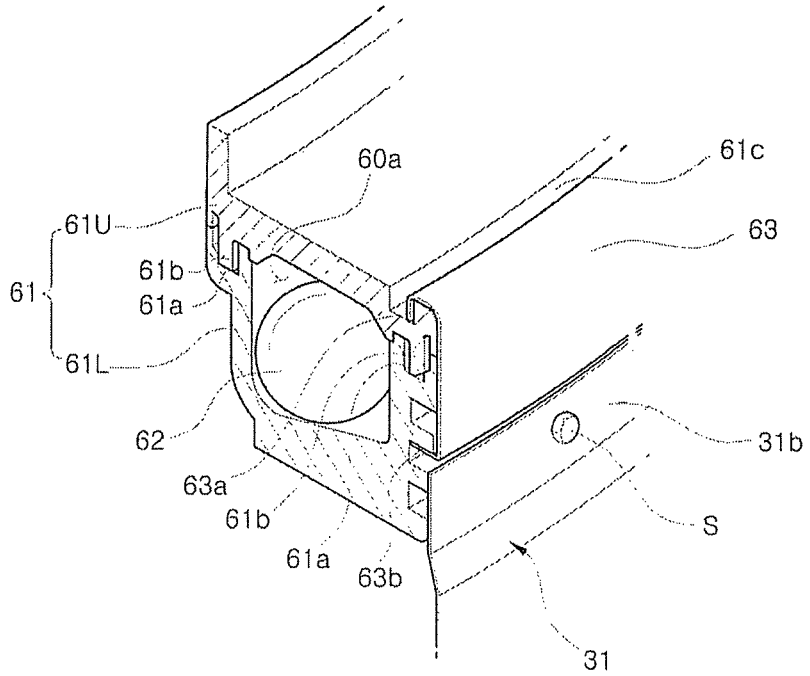
[Fig. 12]
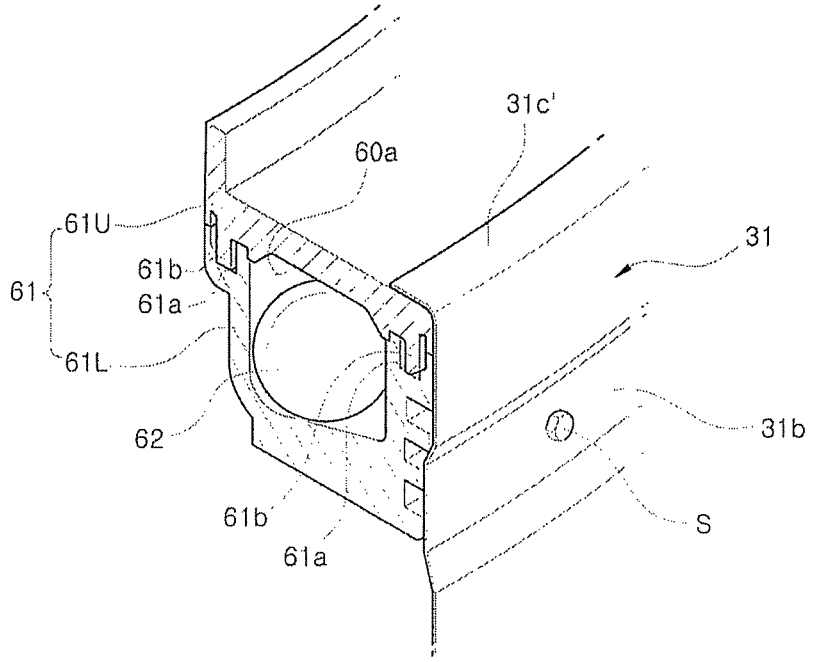

[Fig. 13]
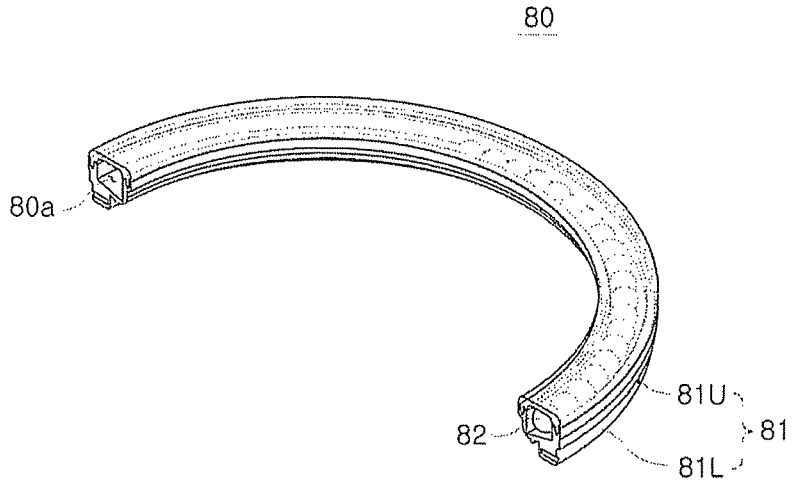
[Fig. 14]
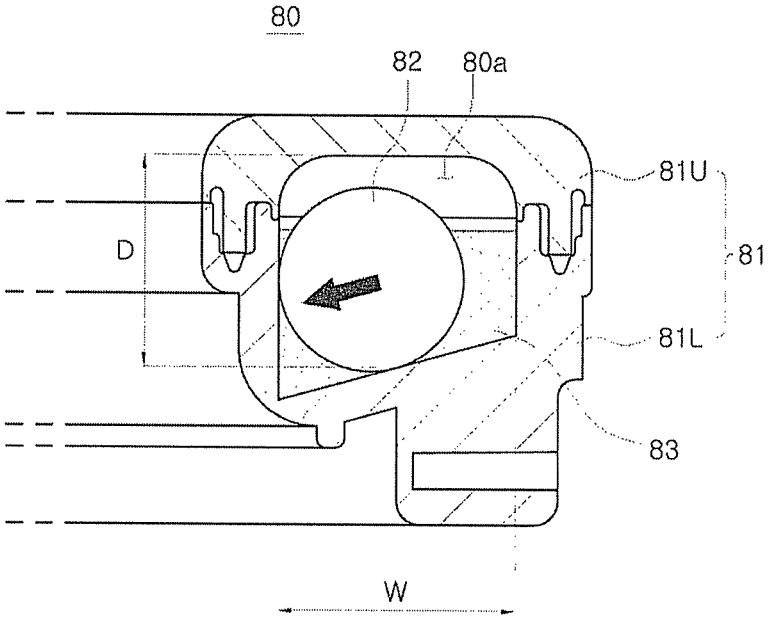

[Fig. 15]
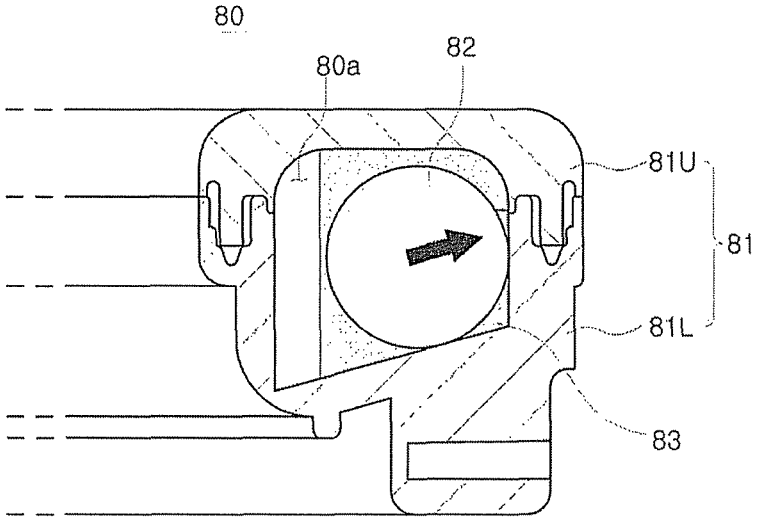

BALANCER AND WASHING MACHINE INCLUDING THE SAME

CROSS-REFERENCE TO RELATED APPLICATIONS

This application is a National Phase Entry of PCT International Application No. PCT/KR2014/005730 which was filed on Jun. 27, 2014, and claims a priority to Korean Patent Application No. 10-2013-0074822 which was filed on Jun. 27, 2013, and claims a priority to Korean Patent Application No. 10-2014-0075182 which was filed on Jun. 19, 2014, the contents of which are incorporated herein by reference.

BACKGROUND

The present invention relates to a washing machine which includes a balancer installed in a rotating tub to allow the rotating tub to stably rotate by reducing the vibrations of the rotating tub during spin-drying.

SUMMARY

Generally, washing machines are apparatuses which include a reservoir which stores water and a rotating tub rotatably installed in the reservoir, in which the rotating tub in which laundry is stored rotates inside the reservoir, thereby washing the laundry.

Recently, among such washing machines, there are washing machines in which balancers are installed on a top end of a rotating tub to early stabilize a rotation of the rotating tub.

Among balancers installed on a rotating tub, there are balancers which include a balancer housing with an annular race and a plurality of balls movably installed in the race.

It is an aspect of the present invention to provide a washing machine capable of reinforcing a strength of a balancer housing which forms a balancer.

It is another aspect of the present invention to provide a balancer capable of restricting movements of balls at a high speed while allowing the balls to smoothly move at a low speed and a washing machine which includes the balancer.

In accordance with one aspect of the present invention, a washing machine includes a cylindrical part formed in a cylindrical shape with an open top, and at least one balancer installed in the cylindrical part, in which the balancer includes a first balancer housing provided with a race in an annular shape with an open top and a second balancer housing to be coupled with the first balancer housing to cover the open top of the race, and the balancer is installed in the cylindrical part to allow an outer circumferential surface thereof to be supported by an inner circumferential surface of the cylindrical part in such a way that a coupling portion of the first balancer housing and the second balancer housing corresponding to the inner circumferential surface of the cylindrical part is covered by the cylindrical part.

The washing machine may include coupling grooves which have an annular shape and are concavely provided in one of the first balancer housing and the second balancer housing and coupling protrusions which have an annular shape and are provided in another to be coupled with the coupling grooves, in which the coupling portion is a portion where the coupling grooves and the coupling protrusions are coupled with each other.

The coupling grooves may be provided on an inner circumference and an outer circumference of the first balancer housing, respectively, and the coupling protrusions may be provided on an inner circumference and an outer circumference of the second balancer housing, respectively.

A pair of the coupling protrusions may be welded onto a pair of the coupling grooves.

The balancer may include an upper balancer installed above the cylindrical part.

The upper balancer may include a holding groove in an annular shape provided on a top surface thereof, and the rotating tub may include an upper holding portion which has a top end bent to be held in the holding groove.

The washing machine may include a mounting portion provided above the cylindrical part, which protrudes toward an inside in a radial direction to allow the upper balancer to be mounted.

The balancer may include a lower balancer installed below the cylindrical part.

The lower balancer may include a holding groove in an annular shape provided on a bottom surface thereof, and the rotating tub may include a lower holding portion which has a bottom end bent to be held in the holding groove.

The balancer may include the race in an annular shape and a plurality of balls movably installed in the race, and a bottom surface of the race may be formed to be outward in a radial direction and to be inclined upward.

A width of the race may be formed to be greater than an average depth of the race.

In accordance with another aspect of the present invention, a balancer which is installed in a rotating body which rotates to allow an axial line thereof to be vertical to a horizontal plane to rotate together with the rotating body includes a balancer housing provided with a race in an annular shape therein, a plurality of balls installed in the race to be movable in a circumferential direction and a radial direction, and a viscous oil which fills the race to have an oil surface at a lower height than diameters of the plurality of balls, in which a bottom surface of the race is toward an outside in the radial direction and is inclined upward.

In accordance with still another aspect of the present invention, a washing machine includes a body, a reservoir installed in the body to store water, a rotating tub formed in a cylindrical shape with an open top and rotatably installed in the reservoir, and a balancer installed in the rotating tub, in which the balancer includes a balancer housing provided with a race in an annular shape therein, a plurality of balls installed in the race to be movable in a circumferential direction and a radial direction, and a viscous oil which fills the race to have an oil surface at a lower height than diameters of the plurality of balls, and a bottom surface of the race is toward an outside in the radial direction and is inclined upward.

As described above, since a balancer is installed in a cylindrical part and a coupling portion of a first balancer housing corresponding to an inner circumferential surface of the cylindrical part and a second balancer housing is supported by the inner circumferential surface of the cylindrical part, a strength of the balancer may be reinforced by the cylindrical part.

Also, as described above, when the balancer rotates at a low speed, since tops of balls protrude above an oil surface of a viscous oil, a viscous force which acts on the balls is relatively small to allow the balls to smoothly move. When the balancer rotates at a high speed, since the balls completely sink in the viscous oil, the viscous force which acts on the balls becomes greater to restrict movements of the balls.

BRIEF DESCRIPTION OF THE DRAWINGS

FIG. 1 is a schematic diagram of a washing machine in accordance with a first embodiment of the present invention.

FIG. 2 is an exploded perspective view of a balancer applied to the washing machine in accordance with the first embodiment of the present invention.

FIG. 3 is a cross-sectional perspective view of an upper balancer.

FIG. 4 is a cross-sectional perspective view of a lower balancer.

FIGS. 5 to 7 are enlarged views of portion A in FIG. 1, which illustrate a process of installing the upper balancer.

FIGS. 8 to 10 are enlarged views of portion B, which illustrate a process of installing the lower balancer.

FIG. 11 is a partial cross-sectional perspective view of a balancer applied to a washing machine in accordance with a second embodiment of the present invention.

FIG. 12 is a partial cross-sectional perspective view of a balancer applied to a washing machine in accordance with a third embodiment of the present invention.

FIG. 13 is a cross-sectional perspective view of a balancer applied to a washing machine in accordance with a fourth embodiment of the present invention.

FIG. 14 is a cross-sectional view illustrating a case in which the balancer applied to the washing machine in accordance with the fourth embodiment of the present invention rotates at a low speed.

FIG. 15 is a cross-sectional view illustrating a case in which the balancer applied to the washing machine in accordance with the fourth embodiment of the present invention rotates at a high speed.

DETAILED DESCRIPTION

Hereinafter, a washing machine in accordance with a first embodiment of the present invention will be described with reference to the attached drawings.

A washing machine in accordance with one embodiment of the present invention is a fully automatic washing machine with a top through which laundry is inserted, and as shown in FIG. 1, includes a housing 10 which forms an exterior thereof, a reservoir 20 disposed in the housing 10 to store water, a rotating tub 30 formed in a cylindrical shape with an open top and rotatably installed in the reservoir 20, and a pulsator 40 installed in the rotating tub 30 to generate a water current, and a driving device 50 which rotates the pulsator 40.

The housing 10 includes an inlet 10*a* provided on a top side thereof to allow a user to insert laundry into the rotating tub 30. A door 11 is pivotably installed on a rear end of a top of the housing 10 to open and close the inlet 10*a* while pivoting.

The housing 10 internally includes a water-supply system 12 disposed above the reservoir 20 to supply water to the reservoir 20 and a drainage system 13 disposed below the reservoir 20 to allow water used for washing to be discharged outward.

Inside the housing 10, the water-supply system 12 for supplying water to the reservoir 20 is disposed above the reservoir 20 and the drainage system 13 for discharging the water used for washing is disposed below the reservoir 20.

The water-supply system 12 includes a water-supply pipe 12*a* connected to an external water supply source (not shown) and a water-supply valve 12*b* disposed on the water-supply pipe 12*a* to open and close the water-supply pipe 12*a*. The drainage system 13 includes a drainage pipe 13*a* connected to a bottom of the reservoir 20 to induce water in the reservoir 20 to be discharged outward and a drainage valve 13*b* disposed on the drainage pipe 13*a* to open and close the drainage pipe 13*a*.

The reservoir 20 is installed in the housing 10 to be suspended therein and stores water to be used for washing.

The rotating tub 30 has an approximate cylindrical shape with an open top, is disposed to allow an axial line thereof to be vertical to a horizontal plane, and rotates on the vertical axial line to perform spin-drying. The rotating tub 30 includes a cylindrical part 31 formed in a cylindrical shape with open top and bottom and a bowl part 32 coupled with the bottom of the cylindrical part 31 to close the bottom of the cylindrical part 31, in which the pulsator 40 is rotatably installed.

The cylindrical part 31 is formed by rolling a plate-shaped member to be in a cylindrical shape. Through holes 31 a are provided in the cylindrical part 31 to allow the water in the reservoir 20 to flow into the rotating tub 30 and simultaneously to allow the water in the rotating tub 30 to be discharged outward. Also, balancers 60 and 70 are installed on the top and bottom of the cylindrical part 31, respectively, to compensate an unbalanced load of the rotating tub 30 to initially stabilize a rotation of the rotating tub 30.

The driving device 50 includes a stator 51 including a coil 51*a*, a rotor 52 which includes a magnet 52*a* which interacts with the coil 51 a and rotates while interacting with the stator 51, and a driving shaft 53 with a bottom connected to a center of the rotor 52 and a top connected to the pulsator 40 to transfer torque to the pulsator 40.

The balancers 60 and 70 include an upper balancer 60 installed above the cylindrical part 31 and a lower balancer 70 installed below the cylindrical part 31.

The upper balancer 60 and the lower balancer 70, as shown in FIG. 2, include balancer housings 61 and 71 which include races 60*a* and 70*a* having an annular shape therein and a plurality of balls 62 and 72 movably installed in the races 60*a* and 70*a*, respectively. Accordingly, the plurality of balls 62 and 72 are allowed to move along the races 60*a* and 70*a* in a circumferential direction.

The balancer housings 61 and 71 of the upper balancer 60 and the lower balancer 70 include first balancer housings 61L and 71L and second balancer housings 61U and 71U vertically coupled with each other to form the races 60*a* and 70*a* therebetween, respectively.

In the embodiment, the races 60*a* and 70*a* having the annular shape with an open top are provided in the first balancer housings 61L and 71L, and the second balancer housings 61U and 71U are coupled with tops of the first balancer housings 61L and 71L and close the open tops of the races 60*a* and 70*a*. Accordingly, the first balancer housings 61L and 71L are formed to have U-shaped cross sections and form bottom surfaces, outer circumferential surfaces, and inner circumferential surfaces of the balancers 60 and 70, and the second balancer housings 61U and 71U form top surfaces of the balancers 60 and 70.

In the embodiment, the first balancer housings 61L and 71L and the second balancer housings 61U and 71U are formed of resins, respectively, and are mutually coupled through welding, etc.

As shown in FIGS. 3 and 4, coupling grooves 61*a* and 71*a* for welding the second balancer housings are provided in concave annular shapes on outer circumferences and inner circumferences of the first balancer housings 61L and 71L, respectively, and coupling protrusions 61*b* and 71*b* which protrude in annular shapes to correspond to the coupling grooves 61*a* and 71*a* and are inserted into and welded onto the coupling grooves 61*a* and 71*a* are provided on outer circumferences and inner circumferences of the second balancer housings 61U and 71U, respectively. Accordingly, the coupling protrusions 61*b* and 71*b* are welded onto the coupling grooves 61*a* and 71*a*, thereby mutually coupling the first balancer housings 61L and 71L with the second balancer housings 61U and 71U.

The upper balancer 60 and the lower balancer 70 are installed inside the cylindrical part 31 and the outer circumferential surfaces thereof are supported by an inner circumferential surface of the cylindrical part 31, which is to allow coupling portions of the coupling grooves 61*a* and 71*a* and the coupling protrusions 61*b* and 71*b* of the first balancer housings 61L and 71L and the second balancer housings 61U and 71U corresponding to the inner circumferential surface of the cylindrical part 31 to be supported by the cylindrical part 31, thereby reinforcing a strength of the coupling portions using the cylindrical part 31.

An mounting portion 31*b* which protrudes toward a radial inside of the cylindrical part 31 to allow the upper balancer 60 to be mounted thereon is provided above the cylindrical part 31. Also, to maintain the balancers 60 and 70 to be more stably installed on the cylindrical part 31, holding grooves 61*c* and 71*c* having an annular shape are concavely provided on a top surface of the upper balancer 60, that is, a top surface of the second balancer housing 61U of the upper balancer 60 and a bottom surface of the lower balancer 70, that is, a bottom surface of the first balancer housing 71L of the lower balancer 70.

The cylindrical part 31 includes holding portions 31*c* and 31*d* formed on a top end and a bottom end thereof, respectively, to correspond to the upper balancer 60 and the lower balancer 70. The holding portions 31*c* and 31*d* are formed by partially bending the top end and bottom end of the cylindrical part 31 and are bent to be inserted into the holding grooves 61*c* and 71*c* and held in the holding grooves 61*c* and 71*c*. That is, the holding portion 31*c* formed on the top end of the cylindrical part 31 is held in the holding groove 61*c* provided on the upper balancer 60 and restricts an upward movement of the upper balancer 60 and the holding portion 31 d formed on the bottom end of the cylindrical part 31 is held in the holding groove 71*c* provided on the lower balancer 70 and restricts a downward movement of the lower balancer 70.

Hereinafter, a process of installing the balancers 60 and 70 in the cylindrical part 31 will be described in detail with reference to the drawings.

As shown in FIG. 5, the upper balancer 60 is inserted into the cylindrical part 31 from above to allow the upper balancer 60 to be mounted on the mounting portion 31*b* as shown in FIG. 6.

The upper balancer 60 is fixed to the cylindrical part 31 using a fastening member S such as a screw while the upper balancer 60 is mounted on the mounting portion 31*b*.

Sequentially, when the holding portion 31*c* to be inserted into the holding groove 61*c* is formed by bending the top end of the cylindrical part 31 as shown in FIG. 7, the upper balancer 60 is restricted in moving upward by the holding groove 61*c* and the holding portion 31*c*, thereby more stably maintaining an installation state of the upper balancer 60 installed in the cylindrical part 31.

As shown in FIG. 8, the lower balancer 70 is inserted into the cylindrical part 31 from below the cylindrical part 31 to insert the lower balancer 70 between the cylindrical part 31 and the bowl part 32 while the bowl part 32 is coupled with the bottom of the cylindrical part 31 as shown in FIG. 9.

The lower balancer 70 is fixed to the cylindrical part 31 using the fastening member S such as a screw while the lower balancer 70 is inserted between the cylindrical part 31 and the bowl part 32.

Sequentially, when the holding portion 31*d* to be inserted into the holding groove 71*c* of the lower balancer 70 is formed by bending the bottom end of the cylindrical part 31 as shown in FIG. 10, the lower balancer 70 is restricted in moving downward by the holding groove 71*c* and the holding portion 31*d*, thereby more stably maintaining an installation state of the lower balancer 70 installed in the cylindrical part 31.

In the first embodiment described above, as described above, the balancers 60 and 70 are installed in the cylindrical part 31 to allow the coupling portions of the first balancer housings 61L and 71L and the second balancer housings 61U and 71U corresponding to the inner circumferential surface of the cylindrical part 31 to be supported by the cylindrical part 31 but are not limited thereto. As shown in FIG. 11, according to a second embodiment of the present invention, the balancer 60 may be installed in an additional supporting member 63 formed in an annular shape to allow the outer circumferential surface of the balancer 60 to be supported by an inner circumferential surface of the supporting member 63 while the coupling portion of the first balancer housing 61L and the second balancer housing 61U corresponding to the inner circumferential surface of the supporting member 63 is allowed to be covered by the supporting member 63, thereby reinforcing the balancer 60 using the supporting member 63. Here, holding portions 63*a* and 63*b* which are held and supported by the first balancer housing 61L and the second balancer housing 61U are provided on a top end and a bottom end of the supporting member 63, respectively.

In the first embodiment described above, the balancers 60 and 70 are installed above and below the cylindrical part 31 but are not limited thereto. Although not shown in the drawings, it is possible to install only the upper balancer 60 above the cylindrical part 31 or only the lower balancer below the cylindrical part.

In the embodiment, the holding grooves 61*c* and 71*c* are provided on the upper balancer 60 and the lower balancer 70 but are not limited thereto. As shown in 12, according to a third embodiment of the present invention, without a component corresponding to the holding groove 61*c*, the holding portion 31*c* may be bent to be parallel to the top surface of the upper balancer 60 or the bottom surface of the lower balancer 70. Otherwise, without both components corresponding to a holding groove and a holding portion, the upper balancer 60 and the lower balancer 70 may be fixed only using a bolt S.

Hereinafter, a washing machine according to a fourth embodiment of the present invention will be described with reference to the attached drawings.

A balancer 80 applied to the washing machine in accordance with the fourth embodiment of the present invention, as shown in FIGS. 13 and 14, includes a balancer housing 81 in which a race 80*a* having an annular shape is provided, a plurality of balls 82 movably installed in the race 80*a*, and a viscous oil 83 formed to have a certain viscosity and fills an inside of the race 80*a* at a certain height. In the embodiment, the viscosity of the viscous oil 83 is 350 cSt and the ball 82 is formed of a steel ball which has a diameter of ¾ inches and a weight of 28 g.

The race 80*a*, as described above, is formed in the annular shape, has a width and height greater than the diameter of the balls 82, and guides movements of the balls 82 in a circumferential direction according to the rotation of the rotating tub 30. The race 80*a* is formed to have the width sufficiently greater than the diameter of the balls 82, which is to allow the balls 82 to also move in a radial direction according to a centrifugal force which acts on the balls 82 while the rotating tub 30 is rotating. The width of the race 80*a* may be designed to have a gap of from 3 to 5 mm from the balls 82.

Also, in the embodiment, a bottom surface of the race 80*a* is formed to be inclined upward toward an outside in the radial direction and an outer circumferential surface of the race 80*a* is formed to be greater than the diameter of the balls 82. This is to allow the balls 82 to move toward the outside in the radial direction along the bottom surface of the race 80*a* formed as an inclined surface only when a rotating speed of the rotating tub 30 becomes a certain level or higher and the centrifugal force which acts on the balls 82 increases to a certain level or higher. That is, when the rotating speed of the rotating tub 30 is the certain level or lower, since gravity which acts on the balls 82 is greater than the centrifugal force, the balls 82 maintains a state of being located inside the radial direction. That is, when the rotating speed of the rotating tub 30 is the certain level or higher, since the centrifugal force which acts on the balls 82 is greater than the gravity, the balls 82 move outside the radial direction.

In the embodiment, an amount of the viscous oil 83 which fills the race 80*a* may be set to allow the balls 82 to completely sink in the viscous oil 83 in a state in which the viscous oil 83 and the balls 82 move in the radial direction due to the centrifugal force.

The race 80*a* has the width relatively greater than a depth thereof. In the embodiment, since the bottom surface of the race 80*a* is formed to be inclined, a width W of the race 80*a* is formed to be relatively greater than an average depth D of the race 80*a*. When the width and depth of the race 80*a* are formed as described above, a width of the viscous oil 83 which moves in the radial direction due to the centrifugal force becomes greater than a height of the viscous oil 83 in a state of filling a lower part inside the race 80*a* due to own weight thereof. Also, accordingly, tops of the balls 82 supported by the bottom surface of the race 80*a* due to the own weight protrude above an oil surface of the viscous oil 83. On the other hand, the balls which move in the radial direction due to the centrifugal force are allowed to completely sink in the viscous oil 83. In the embodiment, an incline of the bottom surface of the race 80*a* may be less than 15 degrees.

When the race 80*a* and the viscous oil 83 are formed as described above, in a case in which the rotating tub 30 rotates at a low speed of a certain speed or lower and the centrifugal force which acts on the balls 82 is small, the balls 82 maintain a state of being located inside the radial direction in the race 80*a*. In such a state, since the tops of the balls 82 are exposed outside the viscous oil 83, a viscous force which acts on the balls 82 is relatively small to allow the balls 82 to move in the circumferential direction.

Also, when the rotating tub 30 rotates at a certain speed or higher and the centrifugal force which acts on the balls 82 is great, as shown in FIG. 15, the balls 82 and the viscous oil 83 move outside the radial direction in the race 80*a*. In such a state, the balls 82 are allowed to completely sink in the viscous oil 83 and the viscous force which acts on the balls 82 is great, thereby restricting movements of the balls 82 in the circumferential direction.

As described above, the balancer 80 applied to a full automatic washing machine has the race 80*a* which has a relatively greater width than a balancer applied to a front-loading washing machine to allow the balancer 80 to smoothly move. When the width of the race 80*a* is formed to be great, in a case in which the rotating tub 30 rotates at a low speed, distances between the axial line of the rotating tub 30 and the balls 82 differ from one another to be alternately arranged or to move together, thereby generating an unbalanced force by the balancer 80.

However, when the bottom surface of the race 80*a* is formed to be inclined according to the embodiment, the balls 82 move along the race 80*a* while being located at substantially same distances from the axial line of the rotating tub 30 according to the rotating speed of the rotating tub 30, thereby preventing the occurrence of the unbalanced force which may be generated when the balls 82 are alternately arranged. Also, when the rotating tub 30 rotates at a high speed, the balls 82 move in the radial direction and sink in the viscous oil 83, thereby reducing the amount of the viscous oil 83 to be used.

The balancer 80 has been described as being installed in the rotating tub 30 in the embodiment but is not limited thereto. The balancer 80 in accordance with the embodiment of the present invention may be applied to a rotating body an axial line of which rotates vertical to a horizontal plane, like the rotating tub 30 in accordance with the embodiment of the present invention, to initially stabilize a rotating of the rotating body.

The balls 82 are allowed to completely sink in the viscous oil 83 while the balls 82 and the viscous oil 83 move in the radial direction due to the centrifugal force but are not limited thereto. The balls 82 may further sink in the viscous oil 83 when being supported by the outer circumferential surface of the race 80*a* due to the centrifugal force than when being supported by the bottom surface of the race 80*a* due to the own weight. For example, it may be designed that balls three-quarters-fully sink in a viscous oil when the rotating tub 30 rotates at a low speed of a certain rotating speed or lower or the balls four-fifths-fully sink in the viscous oil when the rotating tub 30 rotates at a high speed of the certain rotating speed or higher.

Also, the coupling grooves 61*a* and 71*a* are formed on the first balancer housings 61L and 71L and the coupling protrusions 61*b* and 71*b* are formed on the second balancer housings 61U and 71U in the embodiment but are not limited thereto. On the contrary, coupling protrusions may be formed on first balancer housings and coupling grooves may be formed on second balancer housings.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A washing machine comprising:

a cylindrical part formed in a cylindrical shape with an open top; and at least one balancer installed in the cylindrical part, the at least one balancer comprising an upper balancer installed on an upper portion of the cylindrical part, wherein:

the upper balancer comprises a holding groove in an annular shape provided on a top surface of the upper balancer, the cylindrical part comprises an upper holding portion which has a top end bent to be held in the holding groove, the balancer comprises a first balancer housing provided with a race in an annular shape with an open top and a second balancer housing to be coupled with the first balancer housing to cover the open top of the race, and wherein the balancer is installed in the cylindrical part to allow an outer circumferential surface thereof to be supported by an inner circumferential surface of the cylindrical part in such a way that a coupling portion of the first balancer housing and the second balancer housing corresponding to the inner circumferential surface of the cylindrical part is covered by the cylindrical part.

2. The washing machine of claim 1, comprising coupling grooves which have an annular shape and are concavely provided in one of the first balancer housing and the second balancer housing and coupling protrusions which have an annular shape and are provided in the other thereof to be coupled with the coupling grooves, wherein the coupling portion is a portion where the coupling grooves and the coupling protrusions are coupled with each other.

3. The washing machine of claim 2, wherein the coupling grooves are provided on an inner circumference and an outer circumference of the first balancer housing, respectively, and wherein the coupling protrusions are provided on an inner circumference and an outer circumference of the second balancer housing, respectively.

4. The washing machine of claim 2, wherein a pair of the coupling protrusions are welded onto a pair of the coupling grooves.

5. The washing machine of claim 1, comprising a mounting portion provided on an upper portion of the cylindrical part, which protrudes toward an inside in a radial direction to allow the upper balancer to be mounted.

6. The washing machine of claim 1, wherein the balancer comprises a lower balancer installed on a lower portion of the cylindrical part.

7. The washing machine of claim 6, wherein the lower balancer comprises a holding groove in an annular shape provided on a bottom surface thereof, and wherein the cylindrical part comprises a lower holding portion which has a bottom end bent to be held in the holding groove.

8. The washing machine of claim 1, wherein the balancer comprises the race in an annular shape and a plurality of balls movably installed in the race, and wherein a bottom surface of the race is formed to be outward in a radial direction and to be inclined upward.

9. The washing machine of claim 8, wherein a width of the race is formed to be greater than an average depth of the race.

10. A balancer which is installed in a rotating body which rotates to allow an axial line thereof to be vertical to a horizontal plane and rotates together with the rotating body, the balancer comprising:

a balancer housing provided with a race in an annular shape therein;

a plurality of balls installed in the race to be movable in a circumferential direction and a radial direction; and a viscous oil which fills the race to have an oil surface at a lower height than diameters of the plurality of balls, wherein a bottom surface of the race is toward an outside in the radial direction and is inclined upward, and wherein the balancer comprises an upper balancer that comprises a holding groove in an annular shape provided on a top surface of the upper balancer.

11. The balancer of claim 10, wherein a width of the race is formed to be relatively greater than a depth of the race.

12. The balancer of claim 11, wherein the width of the race is formed to be greater than an average depth of the race.

13. The balancer of claim 10, wherein an amount of the viscous oil which fills the race is set to allow the plurality of balls to completely sink in the viscous oil while the plurality of balls and the viscous oil move toward an outside in the radial direction due to a centrifugal force.

14. A washing machine comprising:

a body;

a reservoir installed in the body to store water;

a rotating tub formed in a cylindrical shape with an open top and rotatably installed in the reservoir; and a balancer installed in the rotating tub, wherein the balancer comprises a balancer housing provided with a race in an annular shape therein, a plurality of balls installed in the race to be movable in a circumferential direction and a radial direction, and a viscous oil which fills the race to have an oil surface at a lower height than diameters of the plurality of balls, and a bottom surface of the race is toward an outside in the radial direction and is inclined upward, and wherein the balancer comprises an upper balancer that comprises a holding groove in an annular shape provided on a top surface of the upper balancer.

15. The washing machine of claim 14, wherein a width of the race is formed to be relatively greater than a depth of the race.

16. The washing machine of claim 15, wherein the width of the race is formed to be greater than an average depth of the race.

* * * * *